US005483459A

United States Patent [19]

Tamura

[11] Patent Number: 5,483,459

[45] Date of Patent: Jan. 9, 1996

[54] WIRE MEASURING AND CUTTING APPARATUS AND WIRE CHANGING METHOD USING THE SAME

[75] Inventor: Yoshikazu Tamura, Kanazawa, Japan

[73] Assignee: Sumitomo Wiring Systems, Ltd., Mie, Japan

[21] Appl. No.: 327,840

[22] Filed: Oct. 27, 1994

[30] Foreign Application Priority Data

Nov. 1, 1993 [JP] Japan ..... 5-273806

[51] Int. Cl.[6] ..... H01R 43/00

[52] U.S. Cl. ..... 364/469; 140/140; 83/76.9; 29/755

[58] Field of Search ..... 364/188, 468, 364/469, 471, 472, 562, 474.09; 140/140; 156/433; 226/4, 11, 45, 48; 242/25 R, 7.03; 72/3, 5; 83/61, 76.6–76.9, 298; 29/564.6, 755, 564.1, 564.4, 564.2, 563, 564.8, 868, 825

[56] References Cited

U.S. PATENT DOCUMENTS

| | | | |
|---|---|---|---|
| 4,380,943 | 4/1983 | Evans | 83/298 |
| 4,650,132 | 3/1987 | Droll et al. | 242/7.03 |
| 5,153,839 | 10/1992 | Cross | 364/468 |
| 5,440,804 | 8/1995 | Tamura | 29/825 |

FOREIGN PATENT DOCUMENTS

| | | |
|---|---|---|
| 0036852 | 9/1981 | European Pat. Off. . |
| 5-250935 | 9/1993 | Japan . |
| 2265560 | 10/1983 | United Kingdom . |

OTHER PUBLICATIONS

Abstract of Japanese Unexamined Application 4–270020, Yoshino, Sep. 25, 1992.

*Primary Examiner*—Roy N. Envall, Jr.
*Assistant Examiner*—Steven R. Garland
*Attorney, Agent, or Firm*—Beveridge, DeGrandi Weilacher & Young

[57] ABSTRACT

The wire changing method of the present invention reduces wasteful wires generated whenever wires are changed. When the number of cutting of the wires 28A being produced in a processing device 11 becomes as follows:

$$T=Q-\{INT(R/L)+1\}$$

wherein Q is the number of wires to be produced, R is the passline length, L is the length of one wire to be produced and INT is the conversion code to integer, the operations of the processing device 11 is temporarily stopped. And the wire 28A is cut at the distance X from the entrance B of the passline, said distance X being represented by the equation: $X=L-\{R-INT(R/L)\times L\}$, so as to splice it to the wire of type 28B to be employed next. Thus, the wires remaining in the passline can be utilized effectively and the necessary amount is added as the length of wire to be added, thereby reducing wasteful wires generated at the time of the wire change.

13 Claims, 7 Drawing Sheets

FIG. 6

WHEN ELEVEN SIZE-ADJUSTED WIRES ARE REMAIN,
CHANGE THE WIRE
LENGTH OF THE WIRE TO BE ADDED IS 429mm
NEXT WIRE TO BE SPLICED:
TYPE:AVSS SIZE:0.5 COLOR:0
SPLICE NEXT WIRE AFTER CONFIRMING

WIRE MEASURING AND CUTTING APPARATUS AND WIRE CHANGING METHOD USING THE SAME

BACKGROUND OF THE INVENTION

1. Field of the Invention

The present invention relates to a wire measuring and cutting apparatus for producing a wire having a predetermined length as a constituent element of a wire harness, and a wire changing method using the apparatus.

2. Description of the Prior Art

The wire harness incorporated into automobiles, copying machines, etc. are mainly composed of a plurality of wires which are cut into a predetermined length and crimped with terminals at both ends (hereinafter referred to as "size-adjusted wire"). In order to produce the size-adjusted wire as the constituent element of the wire harness, a wire cutting and measuring apparatus for cutting wires into a predetermined length, stripping the insulative sheath on both ends of the wire and then crimping terminals to both ends of the wire is publicly known (see Japanese Unexamined Patent Publication No. 4-270020).

Further, an apparatus wherein a so-called intermediate stripping mechanism is further provided to the above-described wire measuring and cutting apparatus has been applied as a prior application (see Japanese Unexamined Patent Publication No. 5-250935).

By the way, when the size-adjusted wire is produced by means of the wire measuring and cutting apparatus according to the above prior art, it is necessary to change wires if production conditions are changed. For example, after producing $N_1$ of size-adjusted wires were produced from A wire, $N_2$ of size-adjusted wires were produced from B wire, furthermore, $N_3$ of size-adjusted wires were produced from C wire, etc., thus predetermined number of size-adjusted wires having a predetermined length were produced, respectively, from predetermined wires as to respective production conditions. Therefore, wires are normally changed several times a day in one wire measuring and cutting apparatus. Further, a conventional wire measuring and cutting apparatus had a disadvantage that several meters of unnecessary wire are generated whenever wires are changed.

This disadvantage will be explained with reference to an embodiment of FIG. 7.

A wire measuring and cutting device 1 is fed with wire through a passline 2. On the upstream end of the passline 2, various wound wires 3*a*, 3*b*, 3*c* are arranged, any one of which, for example, a wire 3*a* is retrieved and fed to the wire measuring and cutting apparatus 1 through a passline 2. Here, given the wire cutting location in the wire measuring and cutting apparatus 1 (cutting location due to a cutter) as A, and the wire retrieving exit at the upstream end of the passline 2 as B, then given the length between A and B, i.e. the length of the passline 2 as 11 m, and given 500 of size-adjusted wires of 3 m in length will be produced from wire 3*a*. In the conventional wire measuring and cutting apparatus, in this case, the apparatus 1 is temporarily stopped at the point where 497 of size-adjusted wires have been produced, and wire 3*a* is cut at the point B, then the next wire, for example, wire 3*b* is spliced to wire to produce the next wire, then the wire measuring and cutting apparatus is re-operated to produce the remaining three wires from wire 3*a* remaining in the passline 2.

Here, since the length of the passline is 11 m and that of size-adjusted wires is 3 m, giving eleven divided by three is three with reminder 2 m, thereby generating 2 m of wire as wasteful wire.

SUMMARY OF THE INVENTION

The present invention has been accomplished in order to solve the disadvantages of the conventional apparatus as described above, and it is an object to provide a wire measuring and cutting apparatus and a wire changing method which have been improved to reduce wasteful wires generated whenever wires are changed.

From a certain point of view, the present invention is provided with a wire change control device, by which means the calculation of number of cutting wire made by means of the wire cutting means is performed, that is, the number of wires produced is measured. And when the count value T becomes smaller by N than Q, the number of wires to be produced, which has been set to the production condition setting means, that is, when T=Q–N, the wire change control means stops wire feeding. Also, the wire change control means displays instructions for performing wire change on a displaying means.

Therefore, when the operations of the device stops, an operator can smoothly change wires with those for the next production, according to the instructions for performing wire change displayed on the displaying means.

In the present invention, the predetermined number of wires N is preferably defined as N=INT (R/L)+1. That is, when N reaches to the value consisting of the integer of the quotient obtained by dividing the whole length of the passline by the length of wire to be produced, plus 1, thereupon the wire feeding means is stopped. Therefore, by utilizing the wire remaining in the passline, the remaining number of wires can be produced.

In the present invention, more preferably, the wire length X to be added at the time of wire change is displayed as instructions for performing wire change. Sometimes the wire length remaining in the passline is insufficient for producing the remaining number of wires. Therefore, the wire length X to be added which are necessary for producing the remaining number of wires are displayed. Thus, according to this display, the operator can easily find the wire length X to be added, and can change wires with ease.

In another construction of the present invention, data as to the type of wire to be spliced next are displayed, enabling the operator to select proper wire for the next splicing with confidence.

In still another construction of the present invention, for example, when the operator depresses a start button to restart the processing, the device is operated and the remaining N unfinished wires are produced.

The present invention is, seen from a different point of view, a method comprising utilizing the wire remaining in the passline so as not to waste it when the device actions are stopped at the time of wire change, and adding wire of the insufficient length so as to make the wires changeable when the wire remaining in the passline is insufficient in wire length. Thus, any wasteful wires generated at the time of wire change can be reduced in number.

According to the wire measuring and cutting apparatus of the present invention, an apparatus for reducing wasteful wires generated at the time of wire change can be provided. Particularly, since wire changing is conducted several times a day, the amount of wasteful wires generated whenever wires are changed are reduced, thereby providing an apparatus which can make the most use of resources effectively.

Also, according to the present invention, since the wire remaining in the passline at the time of wire change is insufficient in length, the length of the wire to be added X is displayed on the displaying means. Therefore, the operator can confirm the required length of the wire at the time of wire change on the displaying means, thereby enabling the wire change correctly and speedily.

Furthermore, at the time of wire change, since the data as to the type of wire for the next splicing is displayed on the displaying means, this enables the operator to monitor the display, accurately grasping the wire for the next splicing, thus wire change can be done correctly and speedily.

Also, according to the wire changing method, when changing wires by means of the wire measuring and cutting apparatus, wire change can be performed to reduce wasteful wire generated.

These objects and other objects, features, aspects and advantages of the present invention will become more apparent from the following detailed description of the present invention when taken in conjunction with the accompanying drawings.

BRIEF EXPLANATION OF THE INVENTION

FIG. 6 is a schematic diagram illustrating a displaying example of the display at the time of wire change.

DESCRIPTION OF THE PREFERRED EMBODIMENT

Figure 1:
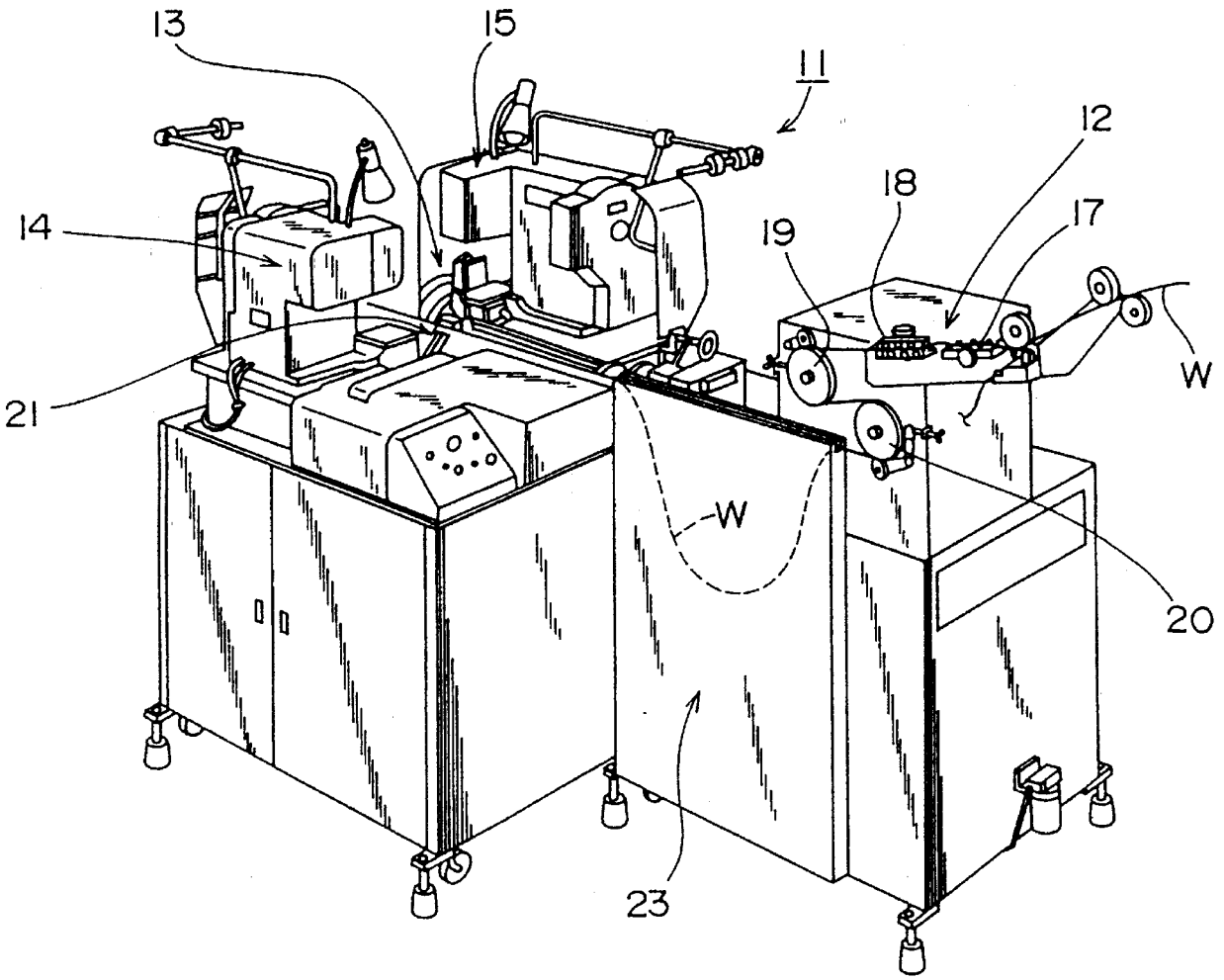
FIG. 1 is a perspective diagram illustrating a processing device as a constituent element of the wire measuring and cutting apparatus according to one embodiment of the present invention.

FIG. 1 is a perspective diagram illustrating a processing device 11 as a constituent element of the wire measuring and cutting apparatus according to one embodiment of the present invention. The construction of the processing device 11 will be explained.

Referring to FIG. 1, the processing device 11 is provided with a feeding section 12, a cutting and stripping section 13, a first terminal crimping machine 14 and a second terminal crimping machine 15.

The wire W fed to this processing device 11 is firstly measured as to the feeding length (length of wire to be fed), then corrected of its bending tendency. For this purpose, the feeding section 12 is provided with a horizontal strainer 17 and a vertical strainer 18 to correct the bending tendency of the wire W, a first feeding roller 19 and a second feeding roller 20 interlocked with this first feeding roller 19. For example, the second feeding roller 20 is provided with an encoder which is not shown in FIG. 1 (this encoder is shown with the reference number 16 in FIG. 4) so as to measure the feeding length of the wire W by means of the second feeding roller 20. An alternative method is to detect the feeding length of the wire W by means of the first feeding roller 19.

The wire W being fed by means of the feeding section 12 is fed to the cutting and stripping section 13, and cut at a predetermined timing so that predetermined length will be obtained. Further, the insulative sheath at the top and rear ends of the cut wire is removed, and the top end of the wire of which insulative sheath has been removed is fed to the first terminal crimping machine 14 by means of a pivoted arm mechanism 21, where the terminal is crimped. Also, the rear end of the wire of which insulative sheath has been removed is fed to the second terminal crimping machine 15 by means of an index table which is not shown in the drawing to be crimped with the terminal.

The processing device 11 is further provided with a wire pool section 23. The wire pool section 23 is provided on the wire feeding passageway between the feeding section 12 and the cutting and stripping section 13. The feeding of the wire W by means of the feeding section 12 is performed sequentially at a constant speed. On the other hand, the cutting and stripping processes of the wire W at the cutting and stripping section 13 is performed by stopping the wire W. Therefore, in order not to stop the wire fed by means of the feeding section 12 even when the top end of the wire W being fed is stopped at the cutting and stripping section 13, a wire pool section 23 is provided. The wire W being fed through a feeding section 12 slackens at the pool section 23, as shown by the dotted lines, thereby sparing frequent stopping of the wire fed through the feeding section 12.

According to the present invention, there may be provided a processing device with an intermediate stripping mechanism as described in Japanese Unexamined Patent Publication No. 5-250935 as a prior application of the applicant of the present application, instead of the processing device 11 shown in FIG. 1.

Figure 2:
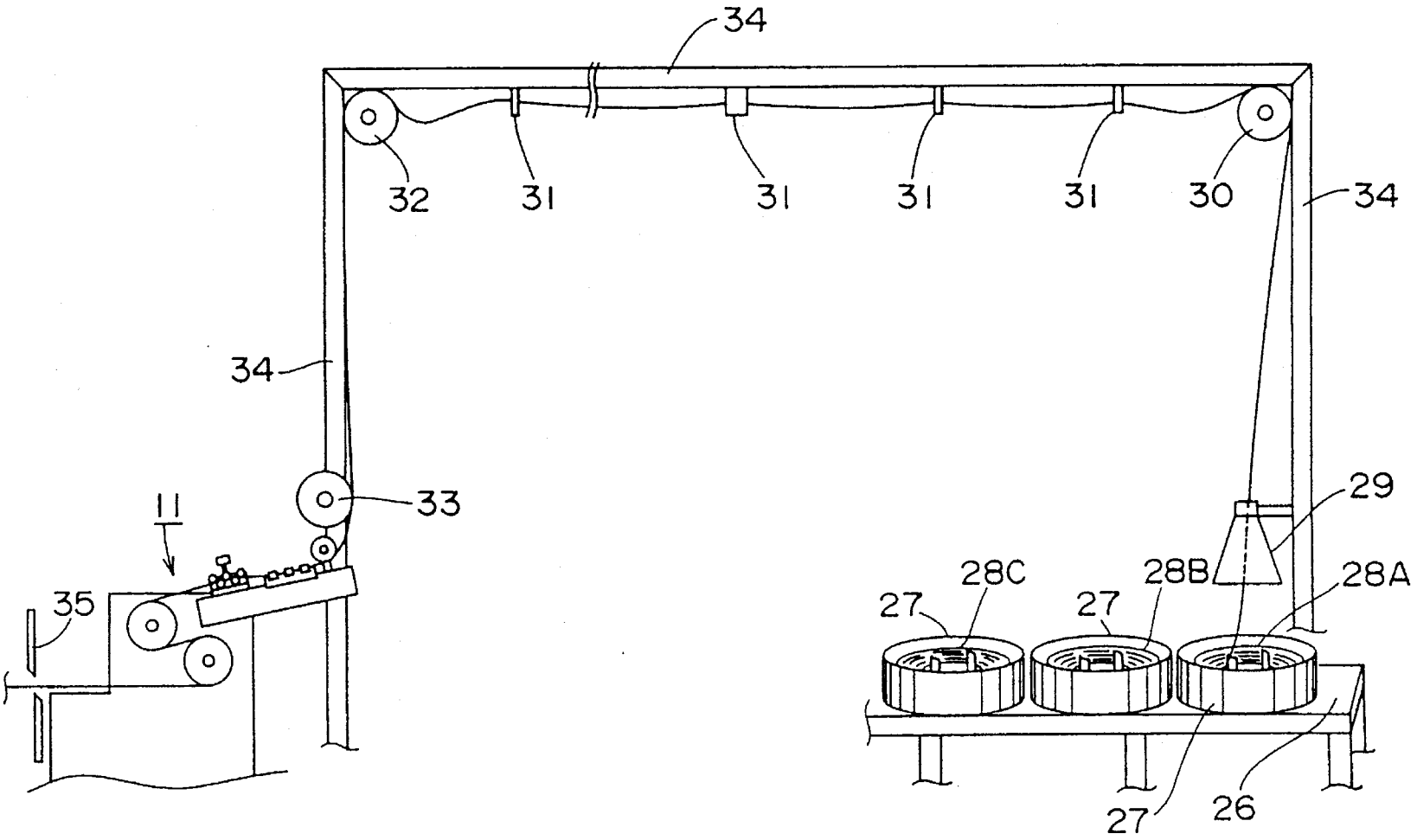
FIG. 2 is an explanatory diagram illustrating a construction of the passline.

FIG. 2 is a schematic diagram illustrating a construction example of the passline of the wire measuring and cutting apparatus according to one embodiment of the present invention.

Referring to FIG. 2, on a wire arraying stand 26, wound wires 28A, 28B and 28C contained in a receptacle vessel 27 are arranged. These wound wires 28A, 28B and 28C are different in types, diameters, colors, etc., respectively. Since the wire measuring and cutting apparatus produces various size-adjusted wires, desired wires are selected from the wound wires 28A, 28B and 28C arranged on the arraying stand 26.

For example, when the wound wire 28A is selected, the wound wire 28A passes through a guide trumpet 29, and is guided by the guide trumpet 29, a roller 30, a plurality of guide jigs 31 and rollers 32 and 33 and then fed to the processing device 11. Rollers 30, 32 and 33 and the guide jigs 31 are provided along a guide bar 34.

For example, as for the passline length R, given the wire retrieving section of the guide trumpet 29 as B, and given the wire cutting location where a wire cutting edge 35 is arranged in the processing device 11 as A, it can be employed as the wire feeding passageway from B to A. However, regarding the wire retrieving section B, it is not restricted to the location B in FIG. 2, but can be freely set in the vicinity of the receptacle vessel 27.

Figure 3:
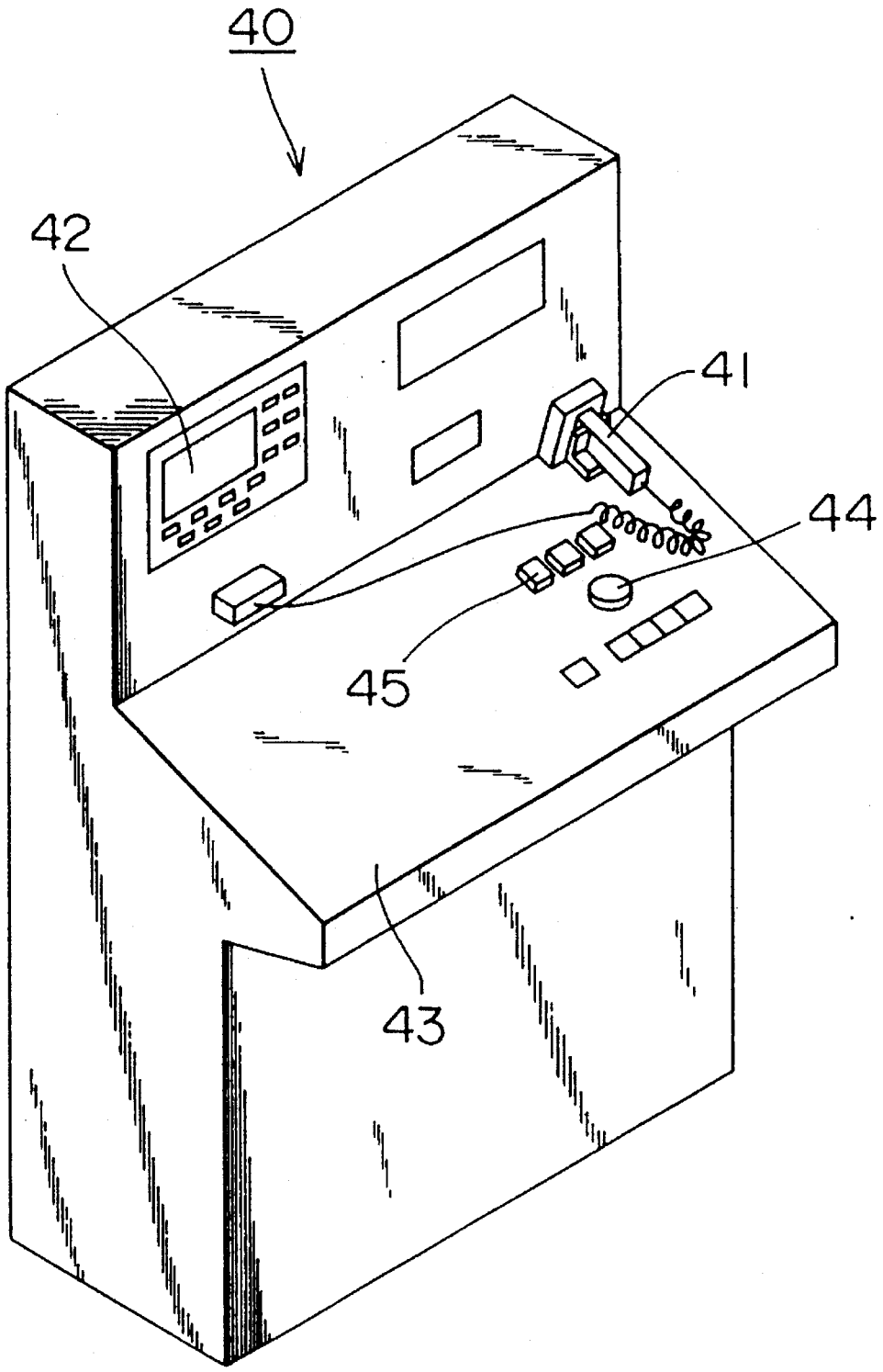
FIG. 3 is a perspective diagram illustrating an external construction of a control device as a constituent element of the wire measuring and cutting apparatus.

FIG. 3 is a perspective diagram illustrating an external construction of the control device 40 as a constituent element of the wire measuring and cutting apparatus according to one embodiment of the present invention. This control device 40 is connected with the above-described processing device 11 (see FIG. 1) so as to control the drive of the processing device 11.

The control device 40 is provided with a bar-code reader 41 for inputting the production data such as length as well as kind, diameter and color of the size-adjusted wire to be produced by means of the processing device 11, number of the size-adjusted wire to be produced, type of the terminals to be crimped to the wire ends, presence/absence of the intermediate stripping, etc. The bar-code reader 41 is for reading the production data from the recording paper with pre-prepared production data (so-called "production label") recorded thereon. Moreover, the control device 40 is provided with an display 42. The display 42 is for displaying the production data read by the bar-code reader 41, and/or the instruction data to be employed at the time of wire change described later. Furthermore, the control device 40 is provided with a work stand 43 to facilitate the operation of the operator, and the work stand 43 is provided with various operating buttons including a start button 44, an initial button 45, etc., arranged thereon.

Figure 4:
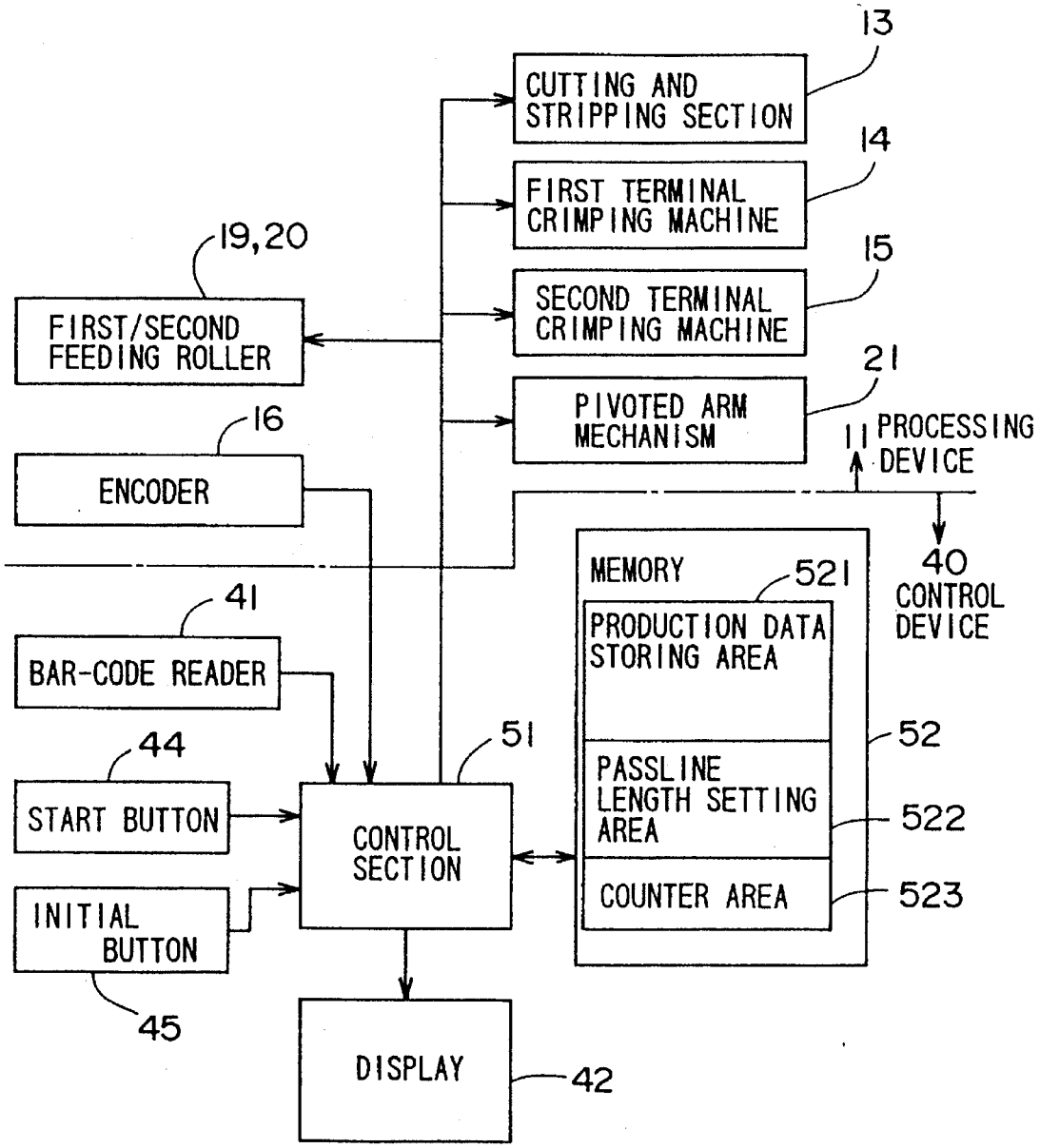
FIG. 4 is a block diagram illustrating the wire measuring and cutting apparatus according to one embodiment of the present invention.

FIG. 4 is a block diagram illustrating the wire measuring and cutting apparatus according to one embodiment of the present invention. The wire measuring and cutting apparatus is provided with a control section 51 for controlling the whole apparatus. This control section 51 is provided in the above control device 40 and is composed of CPU, etc. This control section 51 is supplied with the wire production data read by means of the bar-code reader 41, signals fed from the start button 44 and the initial button 45 as well as data from the encoder 16 provided on the second feeding roller 20 of the feeding section 12.

The control section 51 is connected with the memory 52. The production data fed from the bar-code reader 41 contains, for example, the length of the wire to be produced L, the number of size-adjusted wire to be produced Q, the kind of wire, the diameter of wire, the color of wire, etc. These production data are stored into the production data storing area 521 of the memory 52. The production data storing area 521 has a capacity of storing a plurality of production data. Therefore, a plurality of production labels are read by means of the bar-code reader 41 to get a plurality of the production data, all of which are then stored into the production data storing area 521.

The memory 52 is further provided with a passline length setting area 522 where the data of passline length R is set and stored. When a numerical data inputting key is provided on the work stand 43 of the control device 40, the data of passline length can be input using the numerical data inputting key. Further, a read mode of the bar-code reader 41 is changed and the passline length R represented by the bar-code is input by means of the bar-code reader 41, and the passline length R may be stored in the area 522. Otherwise, when the memory 52 is not provided with the passline length setting area 522 but with a dip switch (not shown) which can be manually operated, the passline length R may be set, for example, by the dip switch.

The memory 52 is further provided with a counter area 523 for counting the number of the size-adjusted wire produced.

The control section 51 also outputs the control signals to the cutting and stripping section 13, the first terminal crimping machine 14, the second terminal crimping machine 15, the pivoted arm mechanism 21, etc., contained in the processing device 11.

Moreover, the control section 51 is connected with an display 42. The control section 51 enables the display 42 to display data, as described later.

Figure 5:
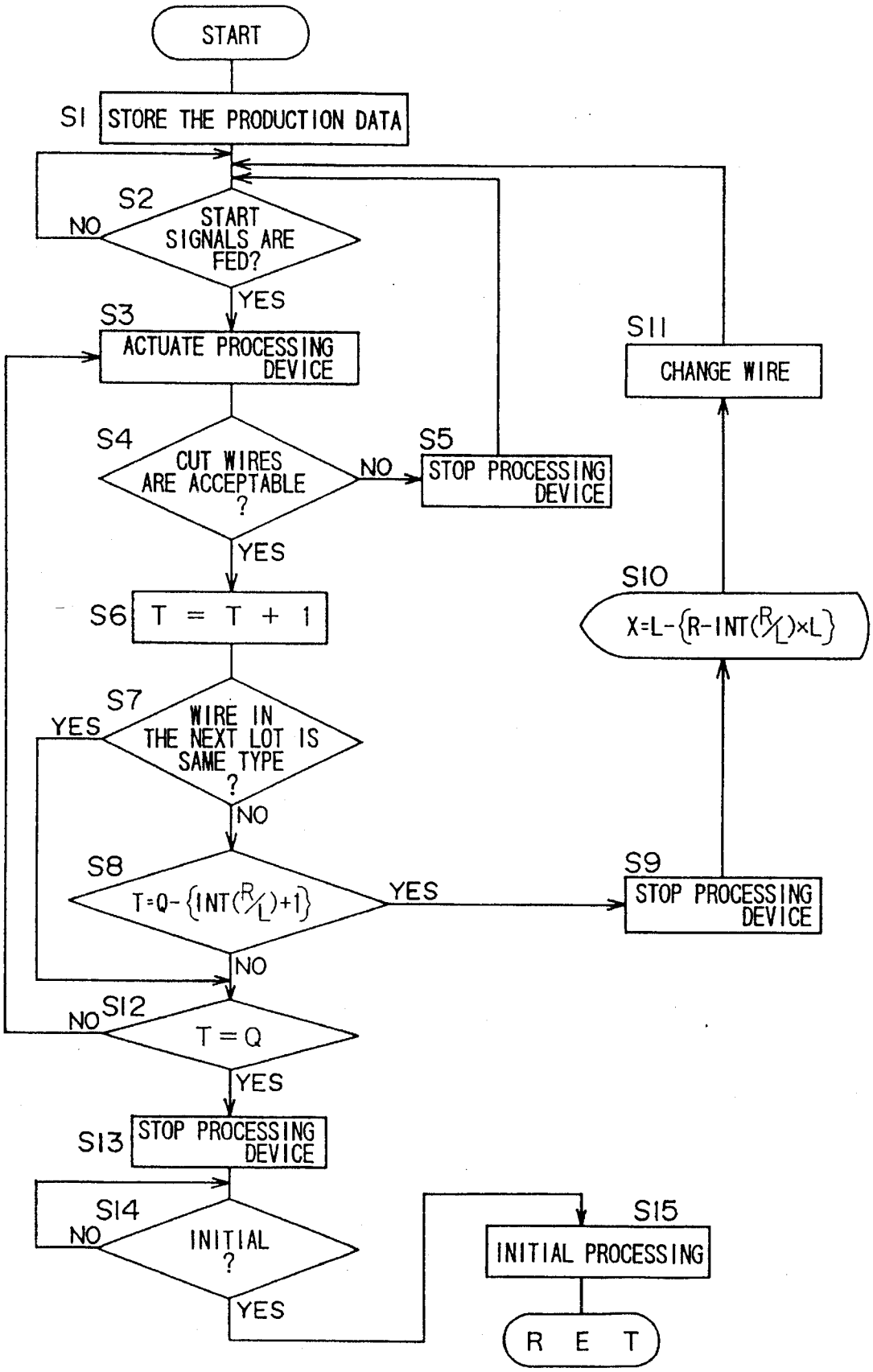
FIG. 5 is a flow chart illustrating an operation of the wire measuring and cutting apparatus according to one embodiment of the present invention.
Figure 7:
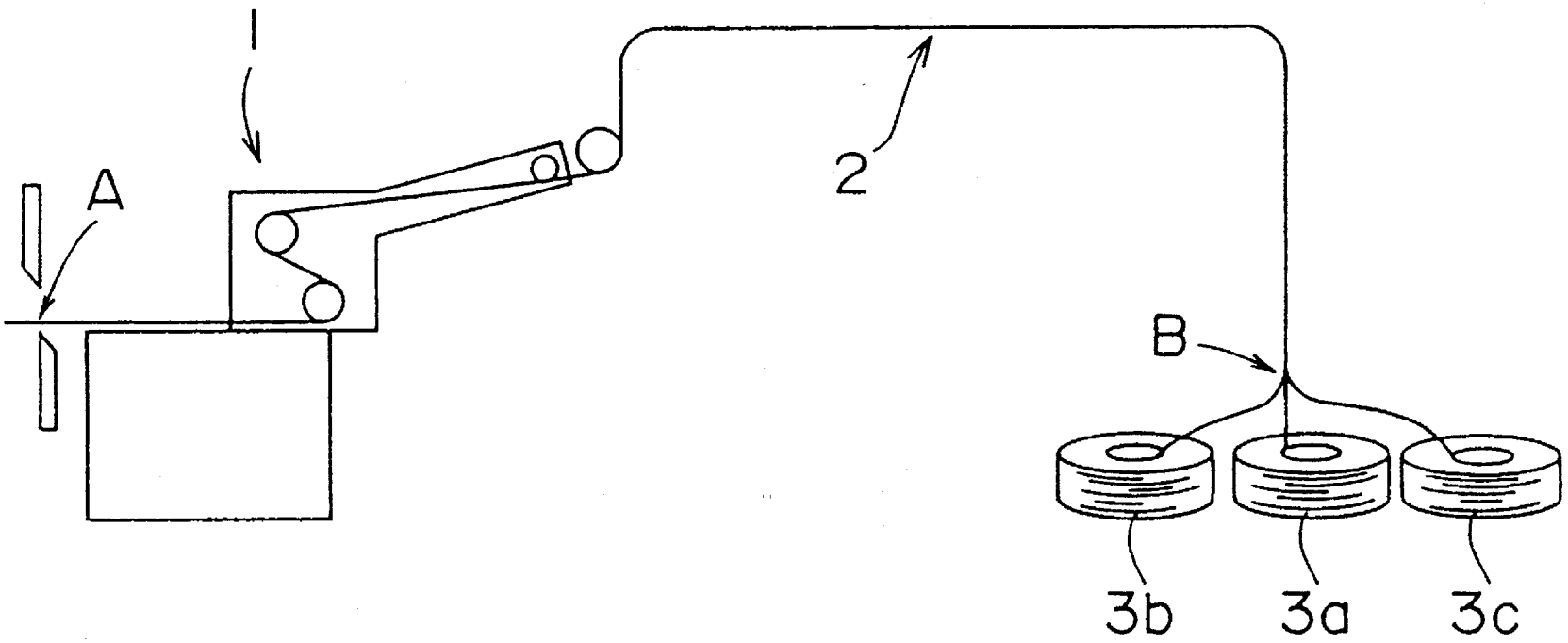
FIG. 7 (PRIOR ART)
FIG. 7 is an explanatory diagram illustrating a problem in a conventional wire measuring and cutting apparatus.

FIG. 5 is an operation flow chart mainly illustrating a control operation of the control section 51 in the wire measuring and cutting apparatus according to this example. The operation of the wire measuring and cutting apparatus of this example will be explained with reference to FIG. 5.

Firstly, the production data are read from the production label by means of the bar-code reader 41 and fed into the control section 51. The control section 51 stores the production data fed from the bar-code reader 41 into the area 521 of the memory 52 (step S1), thereby completing the preparation for the operation. At this time, it is desirable from the point of speeding up the operations to read the production data from a plurality of production labels by means of the bar-code reader 41, then store a plurality of production data into the memory 52. This is because transition from the production of a certain wire to that of the next wire can be done speedily by storing the next production data into the memory 52.

After the completion of the operation preparation, the control section 51 discriminates whether signals are fed from the start button 44 or not (step S2). When the start button 44 is depressed by an operator, the control section 51 discriminates the start signal inputs, operates the processing device 11, and starts producing size-adjusted wires (step S3). In this case, since the processing device 11 is under the control of the control section 51, the processing device 11 is operated to produce size-adjusted wires of wire length L according data stored in the area 521 of the memory 52.

Also, the control device 51 discriminates every time when a cutting is done at the cutting and stripping section 13 whether the wires which have been cut are acceptable or not (step S4). This discrimination can be performed on the bases of the image data fed from the checker camera provided on the cutting and stripping section 13, for example. If, as the result of the discrimination at step S4, the cut wire is found to be unacceptable, the processing device 11 is stopped (step S5). Thereafter, the operator removes unacceptable wire which has been cut, re-sets the processing device 11 and depresses the start button 44 and, as a result, the process is restarted.

On the other hand, at step S4, when the cut wires are found to be acceptable, the count value T at the counter area 523 is incremented by one whenever the cutting and stripping section 13 performs one cutting operation, that is, whenever a wire is produced (step S6).

Next, the control section 51 reads the production data of the next lot stored in the production data storing area 521 of the memory 52, and discriminates whether the wire in the next lot is the same type or not (step S7) and, as a result, if wire of the next lot is not the same type, it is discriminated whether or not the count value T incremented at step S6 has become as follows:

$$T=Q-\{INT(R/L)+1\}$$

wherein INT is a conversion code to integer, the same goes for the followings, Q is the number of wires to be produced, i.e. data contained in the production data stored in the area 521 of the memory 52, R is the above-described passline length, i.e. data previously set in the area 522 of the memory 52, and L is the length of one wire which is also stored as one of the production data as described above (step S8).

For example, given the number of wires to be produced as Q=500, the passline length as R=11 m and the wire length to be produced as L=3 m, since INT(R/L)+1=3+1=4, when the count value T becomes T=500–4=496, the process proceeds to step S9.

Thus, when the count value T, that is, the number of processed wires counted at the counter area 523 becomes T=Q–{INT(R/L)+1}, the control section 51 stops the operations of the processing device 11 (step S9), and enables the display 42 to display the instructions for wire change. It is desirable, along with this instruction, to instruct the display 42 to display the required length of wire of the type now being processed at the time of wire change, i.e. the length of wire to be added (step S10).

This length of added wire X is calculated, for example, from the formula:

$$X=L-\{R-INT(R/L)\times L\}$$

This length of added wire X is calculated on the following bases.

As described above, given the passline length as R=11 m, and the length of wire to be produced as L=3 m, then when the processing device 11 stops, the length of wire present between the passline A and B is 11 m. By the way, in step S8, the processing device 11 is stopped at the 496th wire against Q=500, i.e. four wires less of the number of wires to be produced. Therefore, still four more wires must be produced and, for this purpose, a wire of 12 m (=4×3 m) is required. Since the length of wire remaining in the passline is 11 m, the length of wire to be added will be 1 m, the general formula for this calculation is the above formula, and the length of the wire to be added, X, is given by the above formula as $$X=3-\{11-3\times 3\}=1$$

The length X of wires to be added may be measured manually by an operator (human), and after feeding the measured wires and cutting them, the top end of the next wire may be spliced to the end of the cut wire. Alternatively, the wire length X may not be measured by human hand, and may be fed by adding length through the feeding section 12 in FIG. 1. Also, the feeding of wire length X to be added may be automatically done by adding a length measuring device different from that shown in FIGS. 1 or 2 into the passline.

In FIG. 6, an example of the display contents to be displayed on the display 42 at step S10 is shown. As shown in FIG. 6, on the display 42, there is displayed the instructions that remaining eleven size-adjusted wires must be produced and wire changing is required at this time, and that the wire length X to be added at the time of wire change is 429 mm.

Also, at the time of wire change, the type, thickness (size) and colors of the next wire to be spliced are displayed. When information about the next wire are displayed, the next production data is stored in the area 521 of the memory 52 beforehand, i.e. when production data are read continuously from a plurality of production labels and a plurality of production data are stored into the area 521 beforehand, the next wire data are displayed on the display 42. By monitoring this display, the operator changes wire to the next faultlessly.

Referring again to FIG. 5, the operator performs wire change (step S11), and after the completion, depresses the start button 44.

At the control section 51, in reply to the signals fed from the start button 44 (step S2), the operator re-operates the processing device 11 (step S3). And the cut wire is discriminated whether it is acceptable or not (step S4), and if it is acceptable, the count value T at the counter area 523 is incremented by one (step S6). Then, the wire of the next lot is discriminated whether or not it is the same (step S7). In the case of a series of descriptions as described above, since the wire of the next lot is not the same, the process proceeds to step S8, and since the value T is incremented at step S6, it proceeds to step S12. Then, at step S12, the processes from step S3 to step S12 are repeated till the count value T reaches the number of wires to be produced, Q, the control section 51 stops the operations of the processing device 11 (step S13).

Thus, the production of size-adjusted wires using the initial wire is completed.

After the processing device is stopped, the operator performs the changing of the applicators of the terminal crimping machines 14 and 15 for the purpose of the next wire processing, if necessary.

Thereafter, it is waited for the initial button 45 to be depressed. When the operator depresses the initial button 45 and the input of the initial signal is discriminated by the control section 51 (step S14), the control section 51 drives the processing device 11 and makes it perform initialization treatment (step S15).

An initialization treatment is a treatment to operate the processing device 11 in order to remove the spliced parts of the changed wire and to clear the count values in the counter area 523.

Thereafter, the next wire processing can be made.

Incidentally, in the above step S7, when the wire of the next lot is discriminated as the same, there is no need to change wire when transferring to the production of the next lot, so the discrimination treatment at step S8 is skipped, and the processes of steps from S3 to S12 are repeated till the count value T incremented at step S6 reaches the number Q to be produced.

While there has been illustrated and described what is at present considered to be a preferred embodiment of the present invention, it will be understood by those skilled in the art that various changes and modifications may be made, and equivalents may be substituted for elements thereof without departing from the true scope of the invention. It is intended that this invention not be limited to the particular embodiment disclosed as the best mode contemplated for carrying out the invention, but that the invention will include all embodiments falling within the scope of the appended claims.

I claim:

1. A wire measuring and cutting apparatus comprising:

a wire retrieving section for retrieving wires stored in a wire storing section, a wire cutting location set at a location a predetermined distance from the wire retrieving section, a passline having a predetermined length which guides the wire retrieved from the wire retrieving section and leads it to the wire cutting location, a wire feeding means provided on the passline for feeding wire in the direction of the wire cutting location along the passline, a wire length measuring means provided on the passline for measuring the length of the wire passing through the passline, a production condition setting means wherein at least the following conditions such as type of wire to be employed, length of the wire to be produced and number of wires to be produced are set, a wire cutting means arranged on the wire cutting location which operates to cut wire whenever the wire length measuring means measures the same length as that of the wire to be produced which is set to the production condition setting means, a displaying means for displaying data, and a wire change control means which counts the number of cutting of the wire cutting means and stops the wire feeding means when the number of cutting reaches a value smaller by a predetermined number N than the number of wires to be produced which is set to the production condition setting means and to cause to display of instructions for performing wire change on said displaying means.

2. The wire measuring and cutting apparatus according to claim 1, wherein the number of wires N is represented by the equation:

$$T=Q-N, \text{ and}$$

$$N=INT(R/L)+1$$

wherein INT is a conversion code to integer when the length of the passline is R, the length of the wire to be produced is L, the number of wires to be produced is Q and the number of cutting is T.

3. The wire measuring and cutting apparatus according to claim 2, wherein the instructions for performing wire change include the wire length X to be added at the time of wire change, said wire length X being represented by an equation:

$$X=L-\{R-INT(R/L)\times L\}+\alpha$$

wherein $\alpha$ is a constant not less than zero.

4. The wire measuring and cutting apparatus according to claim 3, wherein the production conditions of plural types of wires to be produced continuously are set in said production condition setting means, and said wire change control means reads out the data about a next wire to be spliced from the production condition setting means and make the data displayed on said displaying means.

5. The wire measuring and cutting apparatus according to claim 4, further comprising a re-start signal inputting means, wherein said wire change control means replies to said re-start signal from the re-start signal inputting means to operate the wire feeding means and to stop the wire feeding means when the number of cutting of the wire cutting means reaches the number of wires to be produced.

6. The wire measuring and cutting apparatus according to claim 3, further comprising a re-start signal inputting means, wherein said wire change control means replies to said re-start signal from the re-start signal inputting means to operate the wire feeding means and to stop the wire feeding means when the number of cutting of the wire cutting means reaches the number of wires to be produced.

7. The wire measuring and cutting apparatus according to claim 2, wherein the production conditions of plural types of wires to be produced continuously are set in said production condition setting means, and said wire change control means reads out the data about a next wire to be spliced from the production condition setting means and make the data displayed on said displaying means.

8. The wire measuring and cutting apparatus according to claim 7, further comprising a re-start signal inputting means, wherein said wire change control means replies to said re-start signal from the re-start signal inputting means to operate the wire feeding means and to stop the wire feeding means when the number of cutting of the wire cutting means reaches the number of wires to be produced.

9. The wire measuring and cutting apparatus according to claim 2, further comprising a re-start signal inputting means, wherein said wire change control means replies to said re-start signal from the re-start signal inputting means to operate the wire feeding means and to stop the wire feeding means when the number of cutting of the wire cutting means reaches the number of wires to be produced.

10. The wire measuring and cutting apparatus according to claim 1, wherein the production conditions of plural types of wires to be produced continuously are set in said production condition setting means, and said wire change control means reads out the data about a next wire to be spliced from the production condition setting means and make the data displayed on said displaying means.

11. The wire measuring and cutting apparatus according to claim 10, further comprising a re-start signal inputting means, wherein said wire change control means replies to said re-start signal from the re-start signal inputting means to operate the wire feeding means and to stop the wire feeding means when the number of cutting of the wire cutting means reaches the number of wires to be produced.

12. The wire measuring and cutting apparatus according to claim 1, further comprising a re-start signal inputting means, wherein said wire change control means replies to said re-start signal from the re-start signal inputting means to operate the wire feeding means and to stop the wire feeding means when the number of cutting of the wire cutting means reaches the number of wires to be produced.

13. A method for changing wires, from a first type wire $W_1$ to a second type wire $W_2$, to be fed through a passline of R in length to a cutting location of a wire measuring and cutting apparatus for measuring and cutting the first type of wire $W_1$ to produce Q size-adjusted wires of L in length, wherein an exit of the passline is said cutting location and an entrance side of the passline is a wire changing location, said method comprising:

stopping operation of the apparatus temporarily when a number of cutting operations T of the wire $W_1$ becomes as follows:

$$T=Q-\{INT(R/L)+1\}$$

wherein INT is a code for conversion to an integer, and cutting the first type wire $W_1$ and splicing it to the second type wire $W_2$ in the vicinity of a location at a distance X from the entrance of the passline, said distance X being represented by an equation:

$$X=L-\{R-INT(R/L)\times L\}+\alpha$$

wherein $\alpha$ is a constant not less than zero.

* * * * *